United States Patent [19]

Matsui et al.

[11] Patent Number: 4,984,749

[45] Date of Patent: Jan. 15, 1991

[54] OPERATION CONTROLLING METHOD FOR TEXTILE MACHINE

[75] Inventors: Isamu Matsui; Shoichi Tone, both of Kyoto, Japan

[73] Assignee: Murata Kikai Kabushiki Kaisha, Kyoto, Japan

[21] Appl. No.: 344,702

[22] Filed: Apr. 28, 1989

[30] Foreign Application Priority Data

May 6, 1988 [JP] Japan ..... 63-110724

[51] Int. Cl.[5] ..... B65H 54/20

[52] U.S. Cl. ..... 242/35.5 R; 242/36

[58] Field of Search ..... 242/35.5 R, 35.5 A, 242/36; 364/470

[56] References Cited

U.S. PATENT DOCUMENTS 4,408,447 10/1983 Sloupensky et al. ..... 364/470 X
4,666,096 5/1987 Heel et al. ..... 242/36
4,682,261 7/1987 Benson et al. ..... 364/470 X
4,736,324 4/1988 Sainen et al. ..... 364/470
4,805,846 2/1989 Ueda et al. ..... 242/36
4,830,296 5/1989 Ueda et al. ..... 242/36 X

FOREIGN PATENT DOCUMENTS 0302364 2/1989 European Pat. Off. ..... 364/470
108004 8/1980 Japan ..... 364/470

*Primary Examiner*—Stanley N. Gilreath
*Attorney, Agent, or Firm*—Spensley Horn Jubas & Lubitz

[57] ABSTRACT

Various conditions for operation, in a machine frame which is constituted from a plurality of yarn processing units, of the individual yarn processing units are set by means of a memory card reading device which is electrically connected to the individual processing units over a bus line, and only by setting a memory card in which conditions suitable for a yarn to be processed are written in position into the memory card reading device, operating conditions of the individual processing units are set collectively.

20 Claims, 4 Drawing Sheets

OPERATION CONTROLLING METHOD FOR TEXTILE MACHINE

Field of the Invention

This invention relates to an operation controlling method for a textile machine.

Related Art Statement

In a textile machine such as a roving frame, a spinning frame or an automatic winder installed in a spinning mill or such as a doubler, a twisting frame or the like, a plurality of yarn processing units called "spindles" as minimum units are installed to constitute such single frame.

Meanwhile, yarns processed by such machines as described above are classified into various types depending upon a raw material such as natural fibers such as cotton, wool, hemp or the like, chemical synthetic fibers such as polyester, nylon or the like, or blended fibers of such natural and chemical synthetic fibers or depending upon a yarn thickness which is represented by a weight per unit length and called "yarn count". Thus, various types of yarns are produced and processed on such machines as described above.

For example, an automatic winder is applied to a step of rewinding spun yarns produced on a spinning frame into packages of a predetermined configuration and a predetermined size while removing defects of the yarns, and it is necessary for operating conditions of the same to be set to optimum conditions in accordance with a type of the yarns. In particular, control elements provided for individual winding units, for example, a rotational frequency of a traverse drum for setting a winding speed, a yarn clearer for detecting a yarn defect, a tension device for setting a yarn tension during running, a contacting pressure device for a package and so on are set to optimum conditions depending upon a type of a yarn.

Such various operating conditions as described above are adjusted for each machine frame or for each unit by an operator. For example, setting of operating conditions of a yarn clearer is performed by means of a clearer adjusting button provided at an end portion of a machine frame, and setting of a winding speed is performed by changing over of a speed change gear provided for each unit. In this manner, it is the existing state of things that setting for individual units is performed for each operating condition by an operator while a button switch or a graduation is watched, and it is a very cumbersome operation. Particularly in a many-kind small-quantity production system in recent years, lot changing (changing of type) is performed comparatively frequently, and even on a single machine, different types of yarns are processed at a time. Thus, there are problems that much time is taken for such setting of conditions as described above and that an artificial mistake in setting cannot be avoided.

Summary and Object of the Invention

It is an object of the present invention to provide an operation controlling method which is best suitable for flexible automation of a spinning mill.

An embodiment of the present invention is constituted such that various conditions for operation, in a machine frame which is constituted from a plurality of yarn processing units, of the individual yarn processing units are set by means of a memory card reading device which is electrically connected to the individual processing units over a bus line, and only by setting a memory card such as, for example, a RAM card in which conditions suitable for a yarn to be processed are written in position into the memory card reading device, operating conditions of the individual processing units are set collectively.

Detailed Description of Preferred Embodiments

In the following, an embodiment of the present invention which is applied to an automatic winder will be described with reference to the drawings.

Figure 3:
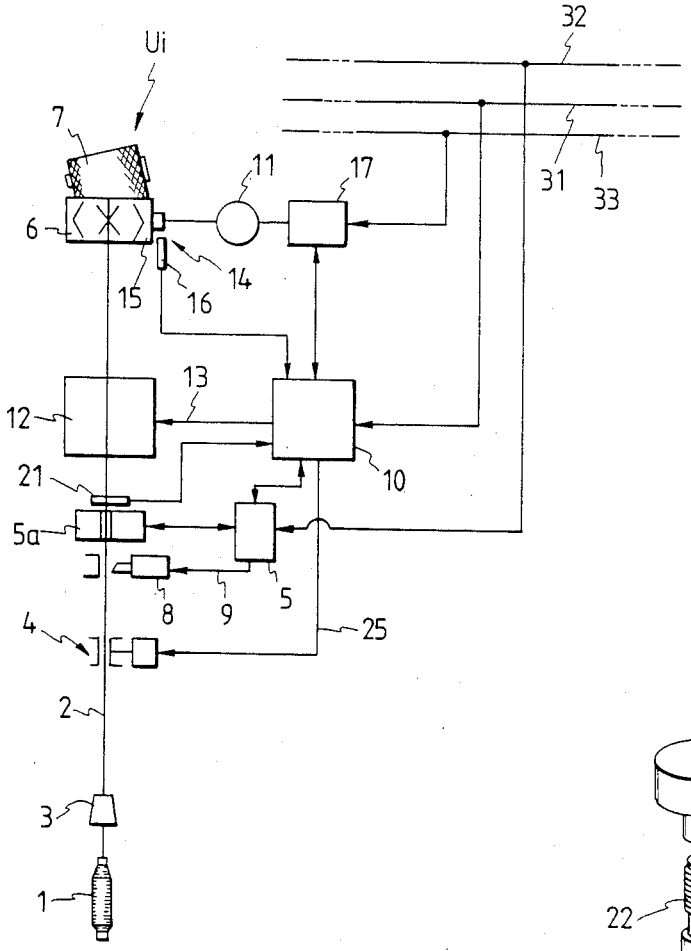

Referring to FIG. 3, there is shown an example of winding unit Ui which is a minimum unit which constitutes an automatic winder. A yarn 2 released from a spinning bobbin 1 passes a balloon breaker 3 and a tension device 4, and then while being checked for a yarn detect by a detecting head 5*a* of a yarn clearer 5, it is wound onto a package 7 which is rotated by a traverse drum 6.

During winding, a variation in thickness of the yarn which passes the head 5*a* of the yarn clearer is inputted as an electric signal to the clearing unit 5, and in case it exceeds, as a result of a comparison calculating processing with a reference value, allowable bounds, it is judged that a defect yarn has passed. Thus, an instruction signal 9 is outputted immediately from the clearing unit 5 to a cutter driving device 8, and a cutter is rendered operative so that yarn cutting is performed compulsorily. As a result of such yarn cutting, the yarn running signal developed from the head 5*a* is turned off, and the yarn break is detected. Consequently, a stopping instruction for a traverse drum driving motor 11 is developed from a unit controller 10 so that rotation of the drum 6 is stopped while a yarn splicing instruction 13 is outputted to a yarn splicing device 12. Consequently, a yarn end on the bobbin 1 side and another yarn end on the package 7 side are spliced to each other by the known yarn splicing device 12.

It is to be noted that reference numeral 14 in FIG. 3 denotes a pulse generator for detecting a rotational frequency of the drum 6. The pulse generator 14 is composed of, for example, a magnet piece 15 secured to a location or each of a plurality of locations on an end face of the drum, and a contactless sensor 16, and is used for a fixed length winding mechanism for calculating an amount of wound yarn from a rotational frequency of the drum 6, or for detection of a number of times of yarn splicing, for calculation of a yarn speed during winding and so on.

Further, in the embodiment described above, the drum driving motor 11 is provided for each of the winding units, and the motor 11 is controlled in rotational frequency by an invertor 17 provided for each of the winding units.

Figure 4:
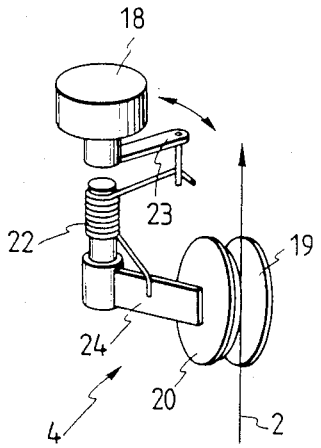

In the meantime, while various types are available for the tension device 4, a type wherein setting of a tension can be made by remote control is preferable for the present invention, and such a device, for example, as shown in FIG. 4 wherein a pressing force of two tension disks 19 and 20 by a spring 22 is controlled by an actuator such as a rotary solenoid 18 is applicable. Reference numeral 23 denotes a movable lever, and 24 a holding lever. Further, a type wherein a tension is controlled by compressed fluid is applicable. It is to be noted that, in FIG. 3, reference numeral 21 denotes a tension sensor. The tension sensor 21 detects a variation in tension of a running yarn, and such detection signal is inputted to the controller 10. The controller 10 delivers, depending upon a comparison calculating processing with a preset tension value, a control signal 25 to the tension device 4. A pressure sensor which utilizes a piezoelectric element is applicable as the tension sensor 21. The tension of the yarn during winding is generally suitable where it is 8 to 12 percent of a strength of a single yarn. Accordingly, a set tension value is set to an optimum value depending upon a yarn count and a type of a yarn.

Operation control of an automatic winder wherein such a winding unit as described above is provided by a large number in a juxtaposed relationship will be described with reference to FIGS. 1 and 2.

Figure 1:
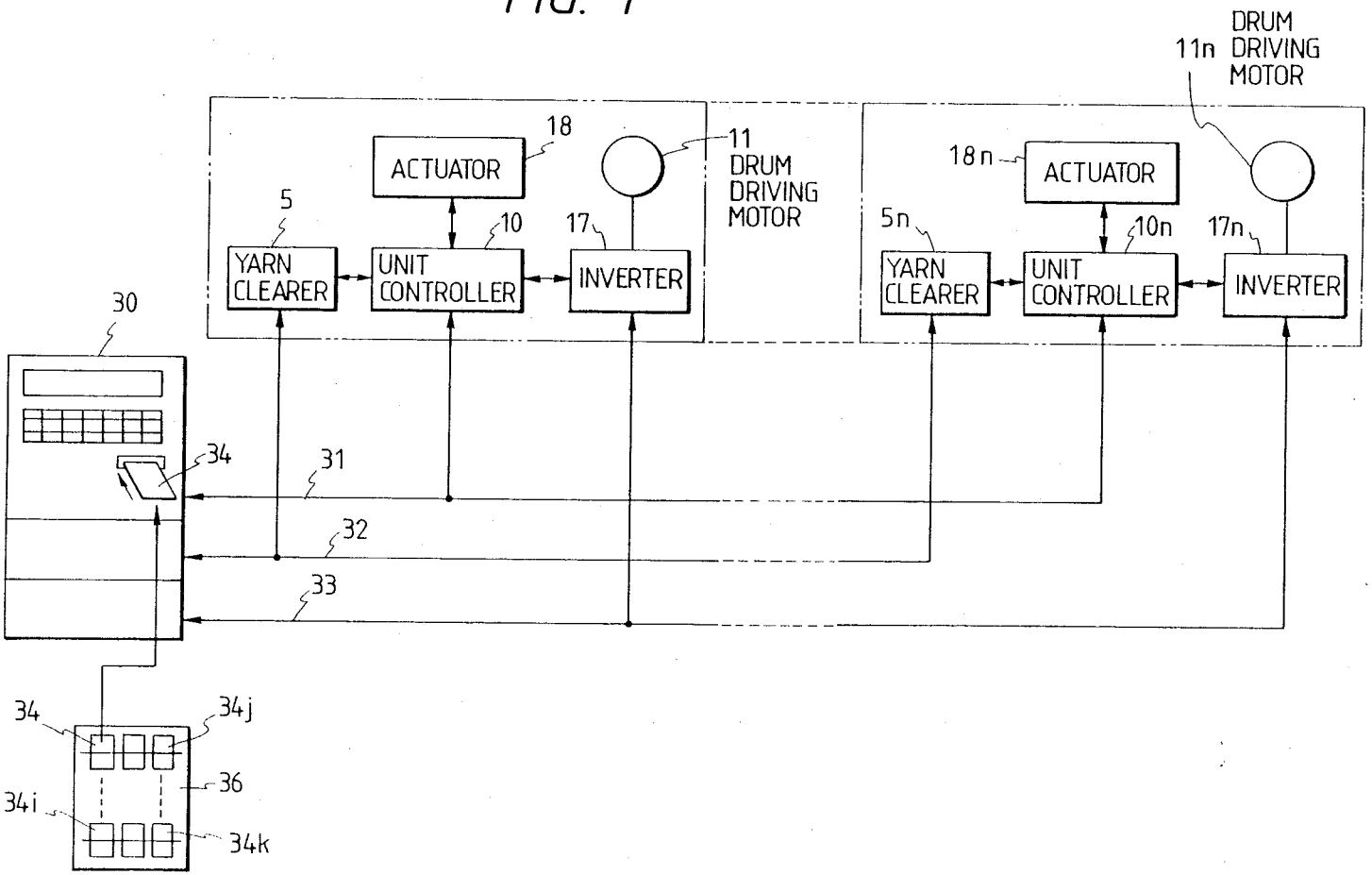
FIG. 1 is an entire constructional view showing a device according to an embodiment of the present invention, FIG. 2 a block diagram showing construction of a control device of the same device, FIG. 3 a schematic constructional front elevational view showing an example of winding unit, FIG. 4 a perspective view showing an example of variable tension device, and FIG. 5 a flow chart of setting of various conditions.

Referring to FIG. 1, a control device 30 for controlling operation of winding units Ul to Un is installed at an end portion of a machine frame, and the control device 30 and the individual winding units are interconnected by means of bus lines 31, 32, 33 and so on for transmission of various information so that operating conditions such as winding speeds for the individual units, sensitivities of yarn clearers, tensions, package contacting pressures and so on are set in a concentrated manner.

A reading device 35 for a RAM card 34 such as a magnetic card in which various operating conditions are erasably stored is provided in the control device 30. Various conditions suitable for yarns to be processed have been inputted in advance by a personal computer or the like to and are stored in the RAM card 34 for various types of yarns and various brands. A large number of such RAM cards 34 are accommodated in a stock rack 36 near the machine frame or in a control room or the like.

Figure 2:
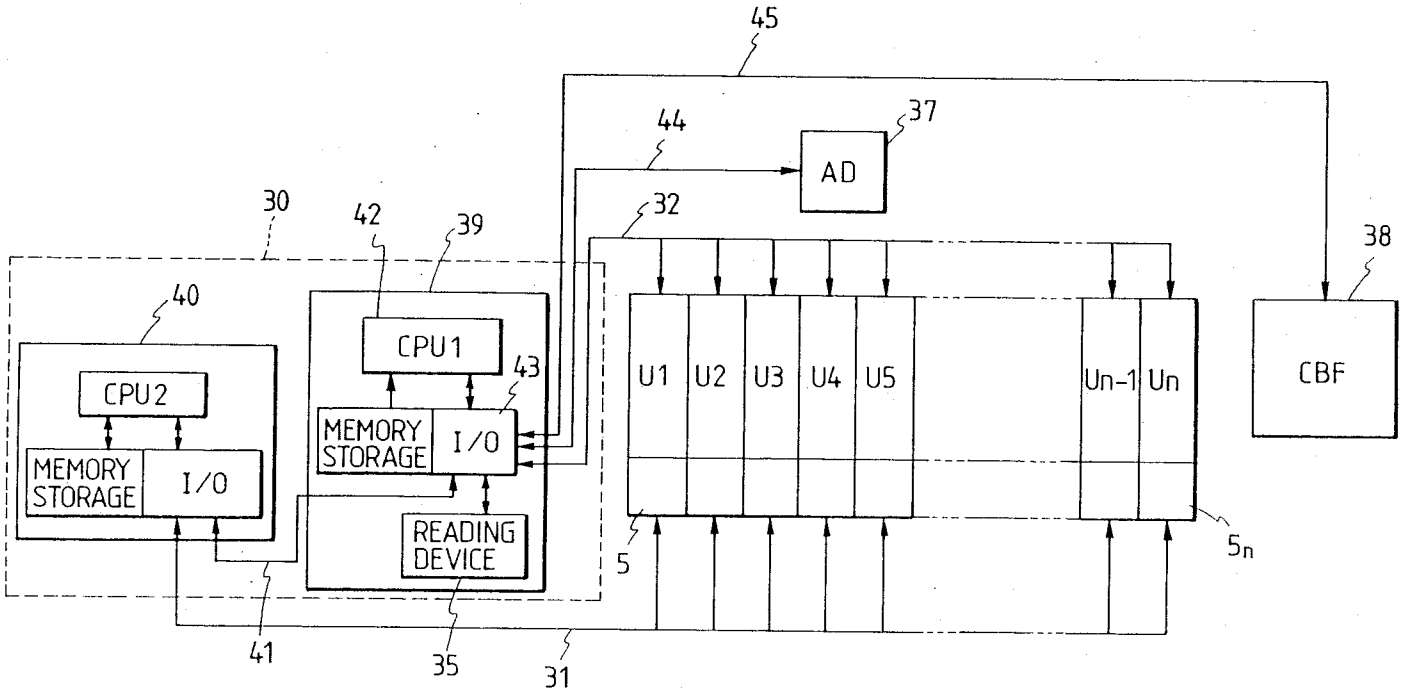

Further, as shown in FIG. 2, the control device 30 executes control of operation of the individual winding units and provision of various conditions relating to operation of an automatic doffing device 37 which moves along the units, an automatic yarn end finding device 38 for a spinning bobbin or the like as well as maintenance and management of such devices.

Meanwhile, referring to FIG. 2, the control device 30 includes a first control section 39 for setting operating conditions such as a yarn speed, a tension, a contacting pressure and so on for each winding unit, and a second control section 40 for automatically setting a clearing condition for the yarn clearer of each unit. In particular, the first control section 39 and the second control section 40 have therebetween a communication bus 41 over which data had by them may be transmitted in the form of analog or digital signals. Accordingly, setting of a condition for the clearer can be automatically executed at the second control section 40 in accordance with operating conditions inputted at the first control section 39.

Accordingly, when a yarn of a certain type and a certain brand is to be rewound, a RAM card in which operating conditions for the brand are written is set in position into the reading device 35 of the control device, and the reader 35 thus reads information on the card so that information of a yarn speed, information of a tension value, information of a contacting pressure and so on are inputted to a central calculating unit 42 such as a microcomputer.

If, for example, tension information is inputted, a calculation based on a relation to obtain a tension value equal to a set value from a characteristic (for example, non-linearity) of an actuator (18 in FIG. 4) is executed at the calculating device 42. Results of such calculation are supplied as an analog signal or as a digital signal to the signal bus lines 32, 33, 44 and 45 by way of a sending unit 43. The form of signals to be supplied to such bus lines may be an optimum one selected in accordance with a transmission distance, a quantity of winding units or the like. At each winding unit, the signal is transmitted by way of the unit controller 10 to change the current to the actuator 18 of the tension device of FIG. 3 to change the torque produced by operation of the actuator 18.

Meanwhile, winding speed information inputted by the RAM card 34 is calculated and processed by the central calculating unit 42 and outputted as a fixed DC voltage from the sending unit 43 by way of a D/A converter to the bus line 32. The voltage is supplied to invertors 17 to **17*n*** provided for the individual winding units Ul to Un so that output frequencies for driving motors are set.

Or, an operating condition for a yarn clearer calculated at the second control section 40 in accordance with the inputs of operating conditions described above is inputted to clearers 5 to **5*n* of the individual winding units over the different bus line 31. In particular, where a yarn clearer detects a variation in thickness and a length of a defect of a yarn, since a reference level as a set level for detection of a variation in thickness varies in accordance with a yarn count and the length of a defect relates principally to a running speed of a yarn, it is possible to determine an operating condition of the yarn clearer in accordance with the operating conditions. Accordingly, where the first control section (principally for setting of operating conditions) and the second control section (for setting of a condition for a yarn clearer) are interconnected by means of the communication bus 41**, it can be eliminated to input operating conditions and an operating condition for a clearer separately from each other.

It is to be noted that, while in the embodiment described above conditions are described set for each winding unit, it is possible in this instance to handle a different type of article for each winding unit.

Further, it is possible to divide the large number of winding units into a plurality of spans each including a plurality of units and set conditions for each span.

Figure 5:
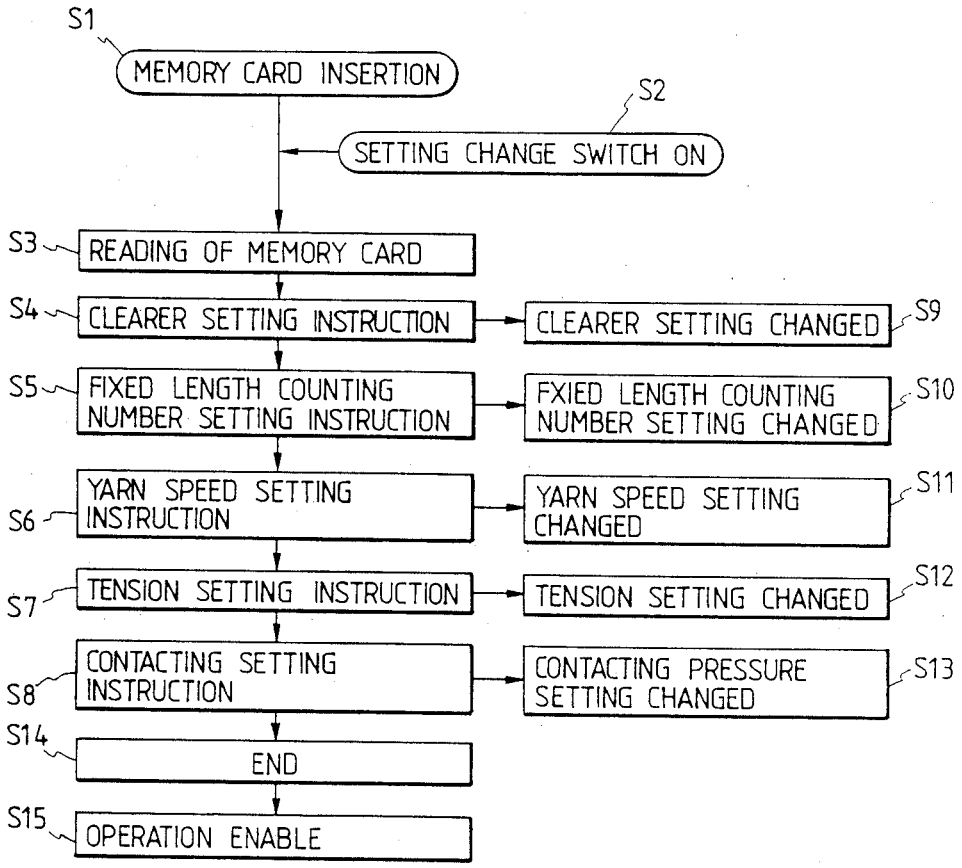

It is to be noted that, if, for example, a weight of a package to be produced is stored in the RAM card described above in addition to a yarn speed, a tension and a contacting pressure described above as information written and stored in the RAM card, then a counter of a fixed length winding mechanism can be automatically set. In particular, as shown in FIG. 5, if a memory card is inserted at step S1 and a setting changing switch is turned on at step S2, then the card reader reads information on the memory card at step S3 and various operating conditions are automatically set at steps S9 to S13 in accordance with a clearer setting instruction at step S4 to a contacting pressure setting instruction at step S8 as a result of communication between the individual units of the winder.

Further, it is possible to compare a yarn count of an actually running yarn with a set yarn count by reversely inputting conditions during operation of the machine frame to the RAM card. In particular, if information obtained from a yarn thickness signal of a yarn clearer is calculated to find out a yarn count, then it can be compared with a set yarn count, and if they are different from each other, then an alarm signal is developed to stop operation of the unit or the machine frame, whereby mixture of different yarn counts can be avoided.

While the embodiment described above relates to a case wherein it is applied to an automatic winder, it can be applied similarly to any other spinning machine.

As apparent from the foregoing description, according to embodiments of the present invention, operating conditions of a machine frame are set collectively at a single location by means of a RAM medium in which operating conditions and so on are stored for different types of yarns and besides operating conditions most suitable for a yarn to be processed are set by a one-touch operation only by insertion of a card. Accordingly, a conventional complicated operation for setting of a large amount of conditions is simplified extremely and occurrence of a mistake in setting can also be prevented.

What is claimed is:

1. Apparatus for controlling the operation of a plurality of yarn processing units, wherein each yarn processing unit is operable with a corresponding yarn clearer, the apparatus comprising;

a storage device for storing data corresponding to processing unit operating conditions to which the yarn processing units can be set;

a control device, operatively connected with the storage device, the control device comprising:

first control means for setting operating conditions for each processing unit according to the processing unit operating conditions corresponding to the stored data;

second control means for calculating and automatically setting a clearing condition for the yarn clearer associated with each unit dependent on the processing unit operating conditions corresponding to the stored data; and communication means for transmitting data between the first control means and the second control means.

2. The apparatus as claimed in claim 1, wherein the apparatus is further operable with an automatic doffing device which moves along the units and an automatic yarn end finding device, and wherein operating conditions set by the first control means comprise at least one of an operating condition for the automatic doffing device and an operating condition for the automatic yarn end finding device.

3. The apparatus as claimed in claim 1, wherein each processing unit further comprises a yarn cutter and wherein each yarn clearer includes means for providing an electrical signal value dependent on a variation in thickness of yarn being processed by the yarn processing unit associated therewith, and means for comparing the signal value with a reference value, means for operating the yarn cutter upon the signal value exceding the reference value.

4. The apparatus as claimed in claim 1, wherein each processing unit processes a running yarn and further comprises:

a tension device;

a tension sensor for detecting a variation in tension of the running yarn; and means for providing a tension signal dependent on the variation in tension and for transmitting the tension signal to the control device;

wherein the control device further comprises means for comparing the tension signal with a preset tension value, and means for providing a control signal dependent on the comparison of the tension signal and the present tension value to the tension device.

5. Apparatus for controlling the operation of a plurality of yarn processing units, wherein each processing unit is operable with a corresponding yarn clearer, the apparatus comprising:

storage means for storing information corresponding to processing unit operating parameters;

reading means for reading information stored by the storage means;

first setting means for setting operating conditions of the units in accordance with information read by the reading means;

calculating means for calculating operating parameters of the yarn clearers dependent on information read by the reading means; and second setting mean s for setting the operating conditions of the yarn clearers in accordance with operating parameters calculated by the calculating means.

6. Apparatus as claimed in claim 5, wherein the operating parameters to which the information stored by the storage means corresponds comprises at least one of a yarn running speed, a yarn tension value, a yarn count, and a yarn package contacting pressure value.

7. Apparatus as claimed in claim 5, wherein:

the first setting means comprises first control means for setting operating conditions for each processing unit, the second setting means comprises second control means for automatically setting a clearing condition for the yarn clearer of each unit, the apparatus further comprises communication means for transmitting data between the first control means and the second control means.

8. Apparatus as claimed in claim 5, wherein:

each yarn clearer comprises means for detecting a value of a variation in yarn thickness of yarn being processed by an associated processing unit and means for comparing the value of a yarn thickness variation with a reference value;

an operating parameter to which the information stored by the storage means corresponds comprises yarn counts;

the calculating means for calculating operating parameters of the yarn clearers comprises means for calculating and setting yarn clearer reference values as values which are dependent on the yarn counts to which the information stored by the storage means corresponds.

9. Apparatus as claimed in claim 5, wherein:

each yarn clearer comprises means for detecting a defect and a value of the length of the defect in yarn being processed by an associated processing unit and means for comparing the value of the length of the yarn defect with a reference value;

an operating parameter to which the information stored by the storage mean s corresponds comprises the yarn running speeds for yarn being processed by the processing units;

the calculating means for calculating operating parameters of the yarn clearers comprises means for calculating and setting the yarn clearer reference values as values which are dependent on the yarn running speeds to which the information stored by the storage means corresponds.

10. Apparatus as claimed in claim 5, wherein:

each yarn clearer comprises means for detecting a defect and a value of the length of the defect in yarn being processed by an associated processing unit, means for comparing the value of the length of the yarn defect with a first reference value, means for detecting a value of variations in yarn thickness of yarn being processed by an associated processing unit and means for comparing a value of a yarn thickness variation with a second reference value;

operating parameters to which the information stored by the storage means corresponds comprise the yarn running speeds and the yarn counts for yarn being processed by the processing units;

the calculating means for calculating operating parameters of the yarn clearers comprises means for calculating and setting the first and second reference values as values which are dependent on the yarn running speeds and yarn counts, respectively, to which the information stored by the storage means corresponds.

11. A method for controlling the operation of a plurality of yarn processing units, wherein each processing unit has an associated yarn clearer, the method comprising the steps of:

storing information corresponding to processing unit operating parameters;

reading stored information;

setting operating conditions of the units in accordance with read information;

calculating operating parameters of the yarn clearers dependent on read information; and setting operating conditions of the yarn clearers in accordance with calculated operating parameters.

12. A method as claimed in claim 11, wherein the operating parameters to which the stored information corresponds comprises at least one of a yarn running speed, a yarn tension value, a yarn count, and a yarn package contacting pressure value.

13. A method as claimed in claim 11, wherein the stored information is stored in at least one magnetic card.

14. A method as claimed in claim 11, wherein:

the step of setting operating conditions of the units comprises the step of setting operating conditions for each processing unit with first control apparatus;

the step of setting operating conditions of the yarn clearers comprises automatically setting a clearing condition for the yarn clearer of each unit with second control apparatus; and the method further comprising the step of transmitting data between the first control apparatus and the second control apparatus.

15. A method as claimed in claim 14, wherein the operating conditions which are set by the first control apparatus comprise:

operating condition for winding;

operating condition of an automatic doffing device which moves along the units; and an operating condition for an automatic yarn end finding device for a spinning bobbin.

16. A method as claimed in claim 15, further comprising the steps of:

detecting the thickness of yarn being processed by a processing unit with the yarn clearer associated with the processing unit;

providing a signal having a value dependent on a variation in thickness of the yarn;

comparing the signal value with a reference value; and cutting yarn in response to the signal value exceeding the reference value.

17. A method as claimed in claim 13, further comprising the steps of:

detecting a variation in tension of a running yarn in each processing unit;

providing a detection signal having a value corresponding to a tension variation;

comparing the signal value with a preset tension value; and providing a control signal dependent upon the results of the comparison to a tension device.

18. A method as claimed in claim 11, wherein operating parameters to which the stored information corresponds comprises yarn counts, the method further comprising the steps of:

detecting, with each yarn clearer, a value of a variation in yarn thickness of yarn being processed by an associated processing unit;

comparing the value of the yarn thickness variation detected by each of the yarn clearers with a reference value associated with each yarn clearer;

wherein the step of calculating operating parameters of the yarn clearers comprises the step of calculating and setting yarn clearer reference values as values which are dependent on the yarn counts to which the stored information corresponds.

19. A method as claimed in claim 11, wherein operating parameters to which the stored information corresponds comprises yarn running speeds for yarn being processed by the processing units, the method further comprising the steps of:

detecting, with each yarn clearer, a defect and a value of the length of the defect in yarn being processed by an associated processing unit;

comparing the value of the length of the yarn defect with a reference value;

wherein the step of calculating operating parameters of the yarn clearers comprises the step of calculating and setting yarn clearer reference values as values which are dependent on the yarn running speeds to which the stored information corresponds.

20. A method as claimed in claim 11, wherein operating parameters to which the stored information corresponds comprises yarn counts and yarn running speeds for yarn being processed by the processing units, the method further comprising the steps of:

detecting, with each yarn clearer, a defect and a value of the length of the defect in yarn being processed by an associated processing unit;

comparing the value of the length of the yarn defect with a first reference value;

detecting, with each yarn clearer, a value of variations in yarn thickness of yarn being processed by an associated processing unit;

comparing the value of a yarn thickness variation with a second reference value;

wherein the step of calculating operating parameters of the yarn clearers comprises the step of calculating and setting the first and second reference values as values which are dependent on the yarn running speeds and yarn counts, respectively, to which the stored information corresponds.

* * * * *